US005211316A

United States Patent [19]

Adalberto et al.

[11] Patent Number: 5,211,316

[45] Date of Patent: May 18, 1993

[54] DUAL-CHAMBER PACKAGE

[75] Inventors: Geier Adalberto, Villazzano, Italy; Karl A. Kohler, Racine, Wis.

[73] Assignees: Coster Tecnologie Specialis p.a., Italy; S. C. Johnson & Son, Inc., Racine, Wis.

[21] Appl. No.: 761,862

[22] PCT Filed: Jan. 16, 1990

[86] PCT No.: PCT/EP90/00085

§ 371 Date: Oct. 14, 1991

§ 102(e) Date: Oct. 14, 1991

[87] PCT Pub. No.: WO90/10583

PCT Pub. Date: Sep. 30, 1990

[30] Foreign Application Priority Data

Mar. 10, 1989 [DE] Fed. Rep. of Germany ..... 3907858
May 2, 1989 [DE] Fed. Rep. of Germany ..... 3914517

[51] Int. Cl.[5] ..... B65D 25/18

[52] U.S. Cl. ..... 222/386.5; 222/402.16

[58] Field of Search ..... 222/95, 105, 183, 386.5, 222/387, 389, 402.1, 402.16, 402.15, 94

[56] References Cited

U.S. PATENT DOCUMENTS

| | | | |
|---|---|---|---|
| 3,317,090 | 5/1967 | Meshberg | 222/386.5 |
| 3,389,833 | 6/1968 | Ramis | 222/95 |
| 3,490,651 | 1/1970 | Abplanalp | 222/94 |
| 3,581,941 | 6/1971 | Bruce et al. | 222/95 |
| 3,731,854 | 5/1973 | Casey | 222/386.5 |
| 3,896,991 | 7/1975 | Kozlowski et al. | 229/55 |
| 4,032,064 | 6/1977 | Giggard | 222/95 |
| 4,265,373 | 5/1981 | Stoody | 222/94 |
| 4,350,272 | 9/1982 | Petterson | 222/386.5 |
| 4,896,794 | 1/1990 | Banks et al. | 222/386.5 X |

FOREIGN PATENT DOCUMENTS

| | | | |
|---|---|---|---|
| 9008703 | 8/1990 | PCT Int'l Appl. | 222/107 |
| 9012741 | 11/1990 | PCT Int'l Appl. | 222/107 |
| 2209805 | 5/1989 | United Kingdom | 222/402.18 |

*Primary Examiner*—Andres Kashnikow
*Assistant Examiner*—Kenneth Bomberg
*Attorney, Agent, or Firm*—Andrus, Sceales, Starke & Sawall

[57] ABSTRACT

A dual-chamber package comprising a substantially dimensionally stable outer container (1) with a dispensing valve (2) for accommodating liquid or pasty contents and an inner container disposed within the outer container (1) for receiving a pressurized gas such as pressurized air or the like, wherein the inner container (3) is a flexible bag and wherein the dispensing valve (2) comprises a dispensing tube (17) disposed within a valve body (14) for movement from a closed position to an open position and vice versa. To simplify the design, increase the operational safety and attain improved ecological compatibility, the inner bag (3) is connected to the dispensing valve (2) and adapted to be filled therethrough with pressurized gas when the outer container (1) has been filled and closed, so that with the dispensing valve (2) in the open state the contents can be ejected from the outer container (1) while the inner bag (3) expands correspondingly.

15 Claims, 4 Drawing Sheets

DUAL-CHAMBER PACKAGE

BACKGROUND OF THE PRESENT INVENTION

The invention is directed to a dual-chamber package comprising a substantially dimensionally stable outer container (1) for receiving liquid or pasty contents and provided with a dispensing valve (2), and an inner container disposed within the outer container (1) for receiving a pressurized gas such as pressurized air, nitrogen or the like, wherein the inner container (3) is designed as a flexible bag and wherein the dispensing valve (2) comprises a dispensing tube (17) disposed within a valve body (14) for movement from a closed position to an open position, and vice versa.

Such dual-chamber packages are generally known, for example from EP-A-0181116, EP-A-0033377 or GB-B-1425854.

The known dual-chamber packages exhibit the common feature that the inner bag includes chemical agents for producing pressurized gas which are activated when a predetermined period of time has elapsed. To this end, for instance in accordance with the proposal of EP-A-0033377, the inner bag includes means for delaying the chemical reaction for producing pressurized gas.

It appears obvious that the mentioned proposals require a considerable design effort. Furthermore, the operational safety is not all that could be desired. Finally, the expenses are additionally increased by the use of chemical agents for producing an adequate quantity of pressurized gas within the inner bag. Due to this fact the ecological compatibility of these known designs is extremely doubtful. Therefore the dual-chamber packages of the specified kind have not been widely accepted for practical use.

SUMMARY OF THE INVENTION

The present invention is based on the object of providing a dual-chamber package of the kind specified in the introductory part which has a simple design, operates safely over prolonged periods of time and is highly compatible in ecological respect.

The above-specified object is solved in accordance with the invention by the characterizing features wherein a dual-chamber package of the invention features a multi-functional dispensing valve. The valve is used, on the one hand, for filling an inner bag with pressurized gas, preferably pressurized air or nitrogen. On the other hand, this dispensing valve may be used to dispense therethrough the contents from the outer container. Due to this dual function of the dispensing valve the design effort is considerably facilitated as compared with the prior art. Furthermore, no separate chemical agents are required for producing pressurized gas. The ecological compatibility of the dual-chamber package according to the invention is extremely good due to the use of pressurized air or nitrogen as the pressurized medium. Since there are no chemical substances for producing pressurized gas and no means for delaying the start of the reaction, the operational safety of the dual-chamber package according to the invention is also far superior to the prior art. Thus, the dual-chamber package according to the invention represents a self-contained, particularly simple and operationally safe design which is considerably less harmful to the environment than the known proposals.

Other features of advantage include when the free space which is bounded by the contents, on the one hand, and by the walls of the outer container and the inner bag, on the other hand, is evacuated as far as possible so as to prevent the formation of an air cushion in the vicinity of the part of the dispensing valve which is inside the container and upstream of the access to the dispensing tube, because such an air cushion would interfere with the dispensing of the contents. Evacuation is preferably effected prior to crimping of the container cover.

Moreover, the configuration of the inner bag is important. It is ensured that the bag expands progressively from bottom to top or from the bottom towards the dispensing valve, respectively, with corresponding dispensing of contents from the outer container. The discharge of the contents is therefore not inhibited by any uncontrolled expansion in the upper or middle region of the outer container. The strength of an additional seal decreases from the dispensing valve towards the bottom of the inner bag so that the desired controlled progressive expansion of the inner bag from bottom to top is ensured.

Furthermore, the design of the dispensing valve is also particularly significant even irrespective, of the above-described design. The features of the dispensing valve enable the above-described function of the dispensing valve in an extremely simple and operationally safe way. It should be noted in this connection that an the elastic element in the form of a helical compression spring, which urges the dispensing tube towards the closed position, has a dual function, viz. to urge the dispensing tube towards the closed position, on the one hand, and to hold the closure plug for the filling opening into the inner bag in the closed position, on the other hand. The closure plug, which is disposed so as to be movable within the valve body of the dispensing valve, also has a dual function, viz. to close the filling opening which opens into the inner bag for introducing gas, on the one hand, and to interrupt fluid communication between the inner space of the outer container and the dispensing valve or the dispensing tube, on the other hand, while the inner bag is being filled with gas. It is mainly the last-mentioned concept which is responsible for the dual function of the dispensing valve.

Conceivable contents include pasty compositions such a ketchup, cream, mayonnaise, skin cream or the like, or liquid substances such as hair dyes, Cologne water or the like.

The dual-chamber package according to the invention is assembled by initially filling the contents into the outer container. Subsequently the inner bag in rolled or longitudinally folded state is introduced through the top opening of the container into the outer container, the inner bag being provided with a riser tube for stabilising it or for improving its buckling resistance, said riser tube being connected to the filling opening of the valve body which opens into the inner bag. During this operation the inner bag is already connected to the dispensing valve. Thereafter, the container cover is crimped in a manner known per se onto the periphery of the opening of the outer container while the free space between outer container, inner bag and cover is evacuated, so that upon the introduction of gas into the inner bag the filled contents can escape upwardly towards the dispensing valve without any significant air cushion being formed. This ensures that on initial use of the dual-chamber package it is not only air that escapes but the desired amount of contents is directly dispensed. Hence, prior to the first use of the dual-chamber package the contents should have risen right to the dispensing opening. The free end of the dispensing tube has a discharge head or spray nozzle mounted thereon as known per se. Since this is a per se known component it will not be described in detail.

Thereafter, the inner bag is filled with gas through the dispensing valve or the dispensing tube thereof. After completion of this step the dispensing tube is pressed still further into the container interior while the afore-mentioned closure plug is moved to the position for closing the filling opening. Now the pressurized gas-filled inner bag is hermetically sealed relative to the environment. The dual-chamber package is ready for use.

It is preferred that the pressurized gas-filled inner bag should fill about one-third of the interior space of the outer container. The introduced pressurized gas it at a pressure of about 9 bars. Two-thirds of the interior space of the outer container is filled with contents. It is then ensured that the contents will be dispensed at a constant pressure of about 3 bars until the container is completely empty.

BRIEF DESCRIPTION OF THE DRAWINGS

Below, preferred embodiments of the dual-chamber package according to the invention will be described with reference to the accompanying drawing, in which.

DESCRIPTION OF THE ILLUSTRATED EMBODIMENT

Figure 1:
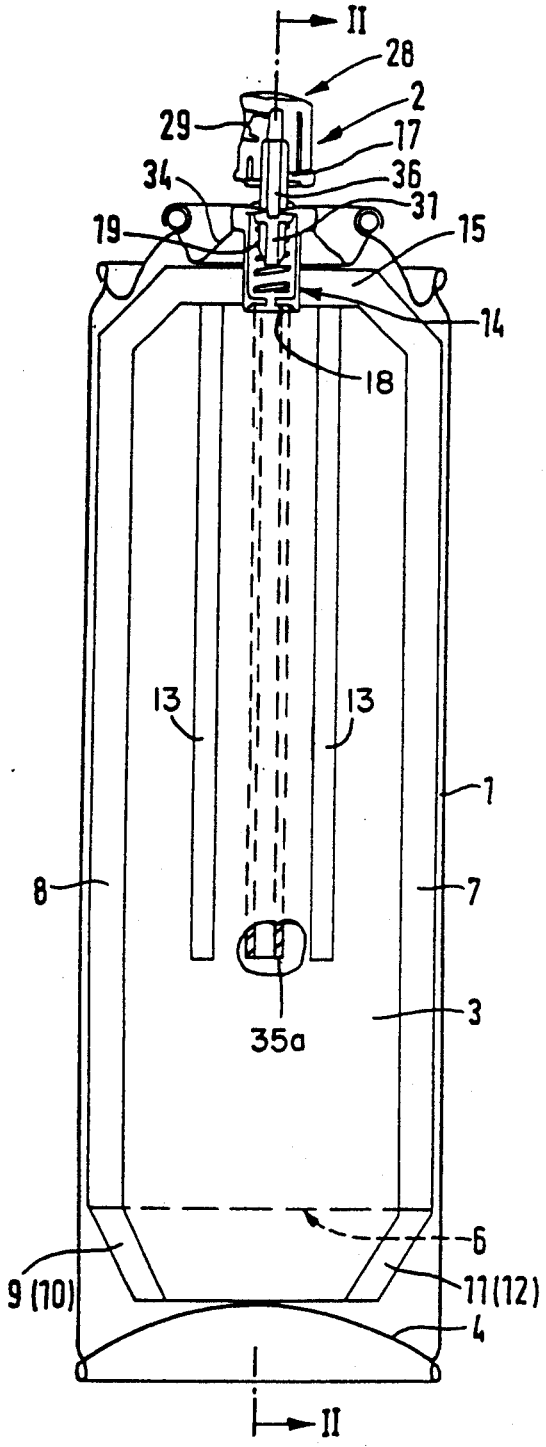
FIG. 1 is a schematic longitudinal section of a dual-chamber package according to the invention.
Figure 2:
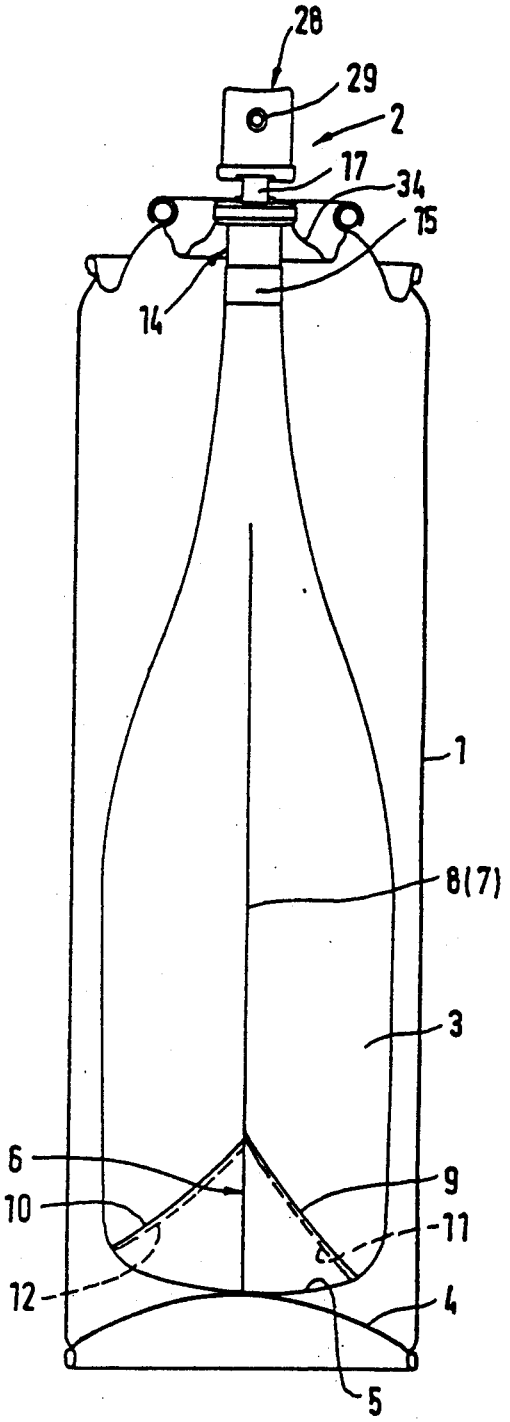
FIG. 2 shows the dual-chamber package of FIG. 1 in which the outer container is shown in section along the line II—II of FIG. 1 whereas the inner bag including the dispensing valve is a side elevation.
Figure 3:
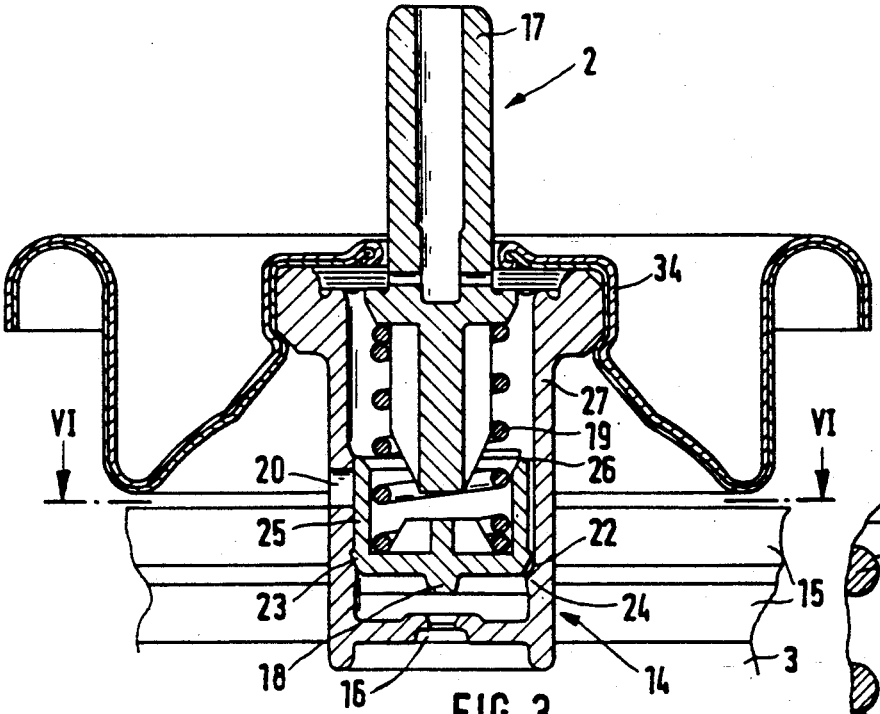
FIG. 3 is an enlarged longitudinal sectional view of a first embodiment of a dispensing valve configured according to the invention prior to assembly with the outer container.
Figure 6:
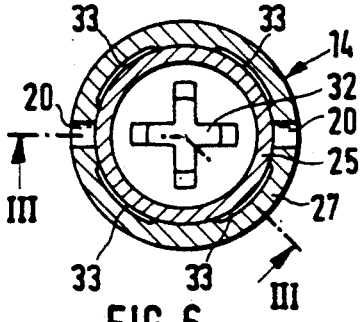
FIG. 6 is a cross-section along the line VI—VI of FIG. 3 showing the dispensing valve of FIG. 4.
Figure 5:
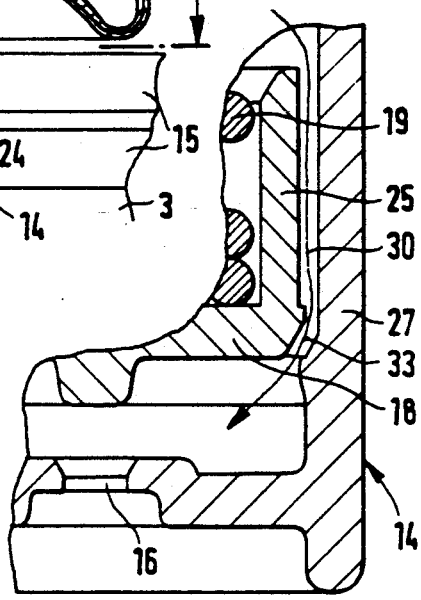
FIG. 5 illustrates part of the dispensing valve of FIG. 4, wherein the flow of pressurized gas past the closure plug is shown.

The dual-chamber package schematically illustrated in FIGS. 1 and 2 comprises a substantially dimensionally stable outer container 1 for liquid or pasty contents which is made, for example, of tinplate and provided with a dispensing valve 2 and an inner container in the form of a flexible bag 3 disposed within the outer container 1 for receiving pressurized gas such as pressurized air, nitrogen or a similar ecologically harmless gas. The dispensing valve 2 comprises a dispensing tube 17 which is mounted in a valve body 14 for movement, i.e. axial movement, from a closed to an open position and vice versa. The inner bag 3, which is made from a multi-layered plastic sheet material with aluminium laminated on the outside, is connected to the dispensing valve 2 and adapted to be filled through the same with pressurized gas after the outer container 1 has been filled with contents and closed, so that with the dispensing valve 2 open the contents can be ejected from the outer container 1 through the already mentioned dispensing tube 17 while the inner bag 3 expands correspondingly. As will be apparent from FIGS. 1 and 2, the inner bag 3 extends substantially along the entire length of the interior of the outer container 1 and is cut and folded in such a way that it will expand by forming a tube that substantially completely fills out the interior of the outer container 1 progressively from the bottom 4 of the outer container 1 towards the dispensing valve 2, as can be seen in FIG. 2. Specifically, the inner bag 3 is formed by a multi-layered sheet material of the above-mentioned kind which is folded upon itself and sealed along the edges, the folding at the bottom being such that upon filling of the inner bag 3 with pressurized gas a substantially flat bag bottom 5 will be formed to extend across the container bottom 4. This is meant to ensure that only a minimum of contents will remain in the bottom area of the outer container 1 and that the container 1 will be emptied substantially completely starting from the bottom 4 thereof. The formation of a flat bag bottom 5 may be achieved, for instance, by folding the bottom of the inner bag 3 in such a way that it includes an inwardly directed V-fold 6 which extends transversely between the two diametrical sealed longitudinal edges 7 and 8 of the inner bag 3. At its diametrically opposed ends the V-fold 6 is bounded by obliquely inwardly extending sealing edges 9, 10 and 11, 12 forming extensions of the two longitudinal sealing edges 7 and 8. In FIG. 2, the sealing edges 11, 12 are each invisibly disposed behind the sealing edges 9 and 10, respectively.

In order to ensure the mentioned progressive expansion of the inner bag 3 from bottom to top with a corresponding discharge of the contents through the dispensing valve 2 in a controlled way, the portions of sheet material folded on top of each other to form the inner bag 3 are sealed to each other starting from the top end facing the dispensing valve 2 towards the bottom-side end in the area between the two longitudinal sealing edges 7 and 8, this additional seal 13 being significantly weaker, especially by about 40 to 50% weaker than the longitudinal edge seals 7 and 8, respectively. According to FIG. 1 the additional seal 13 extends from the upper end of the inner bag 3 facing the dispensing valve 2 along approximately two-thirds of the overall length of the inner bag 3, said additional seal 13 being formed by two parallel and mutually spaced sealing strips. The sealing strips may also be discontinuous, especially so as to be effective only spot-wise. It is preferred that the strength of the additional seal 13 increases towards the dispensing valve 2, whereby the controlled progressive expansion of the inner bag from bottom to top is promoted. A spray head 28 with a spray nozzle 29 is also provided on the free end of the dispensing tube 17 which projects from the outer container 1. This component is a generally known structural element which need not be described in detail.

The specially adapted dispensing valve shall be described with reference to FIGS. 3 to 8. The valve body 14 of the dispensing valve 2 extends in sealed fashion relative to the interior of the outer container right into the inner bag 3 in the vicinity of the upper edge seal 15 facing towards the dispensing valve 2, the edge seal 15 surrounding the outer side of the valve body 14 in fluid-tight fashion. At the lower end which is inside the container the valve body 14 is provided with a filling opening 16 which opens towards the interior of the inner bag 3 and through which the inner bag 3 is filled with gas and which can be closed by a closure plug 18 when the inner bag 3 has been filled with pressurized gas via the dispensing valve 2 or the dispensing tube 17 thereof, respectively. The closure plug 18 is configured so that in its initial position, i.e. in a position for filling the inner bag 3 with pressurized gas as illustrated in FIGS. 3 to 6, it closes a through-opening 20 which communicates the interior of the outer container 1 with the interior of the valve body 14, so that accordingly fluid communication between the interior of the outer container 1 and the dispensing tube 17 of the dispensing valve 2, which tube is axially movable in the valve body 14, is interrupted while the inner bag 3 is being filled with pressurized gas. An axially effective elastic member, especially a helical compression spring 19, is provided between the closure plug 18 and the dispensing tube 17, and the dispensing tube 17 is axially urged into the valve body 14 against the action of said spring to thereby open a fluid communication with the outside, the closure plug 18 for filling the inner bag 3 with pressurized gas being held inside the valve body 14 at an initial position lifted off the filling opening 16 to the inner bag 3, in which initial position pressurized gas can be introduced into the inner bag 3 through the dispensing tube 17, which is axially pressed into the valve body 14, and past the outside of the closure plug 18 (see flow-indicating arrows 30 in FIGS. 4 and 5). When the inner bag 3 has been filled with pressurized gas the closure plug 18 is moved according to FIG. 7 by overcoming locking means (circumferential ridges 22, 23) retaining the closure plug 18 in its initial position, through the dispensing tube 17 urged still further into the valve body 14 to the closing position in which it closes the filling opening and in which it is permanently retained by locking means (annular protrusion 24). It is preferred that the closure plug 18 is made from a harder material than the valve body 14, especially from a plastics material such as rigid PVC. In accordance with the illustrated embodiment the side of the closure plug 18 facing the dispensing tube 17 includes a cup-like guide sleeve 25 into which the portion of the helical compression spring 19 that faces the container interior extends and the outer circumferential rim 26 of which projects radially outwardly with a sharp edge and thereby tends to inhibit movement of the closure plug 18 from the closing position of the filling opening according to FIG. 7 by resting said circumferential rim against the inside of the peripheral wall 27 which bounds the valve body 14 laterally. In this position the closure plug 18 is therefore retained by the helical compression spring 19, the sharp-edged peripheral rim 26 and the radially inwardly projecting locking protrusion 24 which cooperates lockingly with the radially outwardly extending annular protrusion 23 of the closure plug 18.

Figure 4:
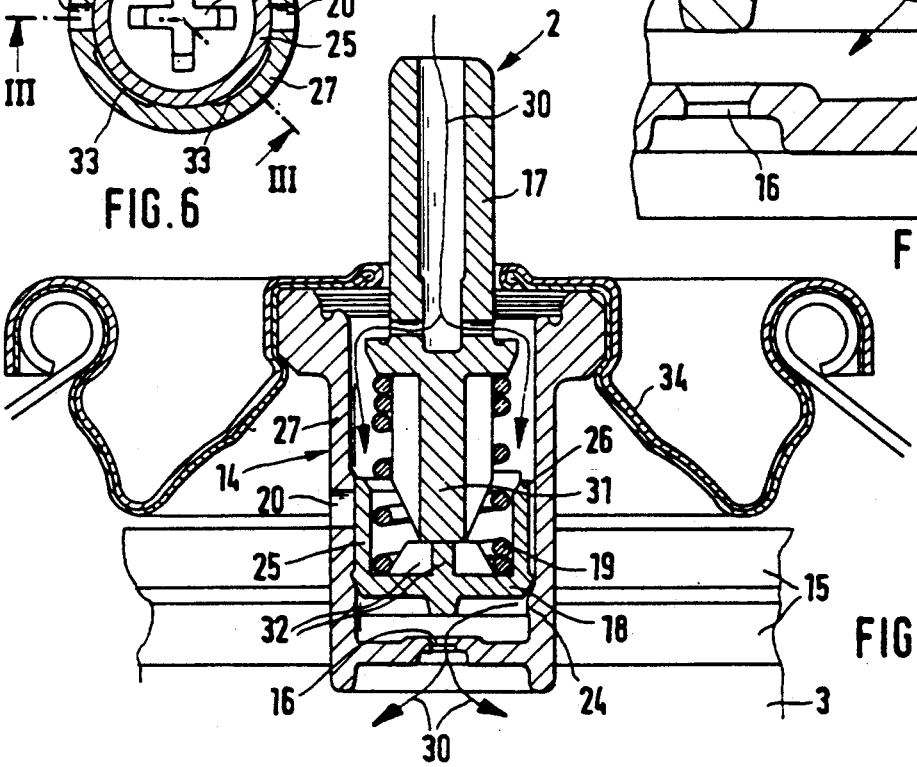
FIG. 4 is the assembled dispensing valve of FIG. 3 in a position for filling the inner container with gas.

As will be apparent from FIG. 4, when the inner bag 3 is filled with gas the end 31 of the dispensing tube 17 which is inside the container rests against an upwardly projecting cross-shaped boss 32 of the closure plug 18, said boss 32 extending from the bottom of the cup-like guide sleeve 25.

As explained above, when gas is to be introduced the cup-like closure plug 18 is held at a position lifted off the filling opening 16 by locking means 22, 23 in the form of radially protruding circumferential ridges formed on the inside of the cylindrical wall 27 which laterally bounds the valve body 14, on the one hand, and on the outside of the guide sleeve 25, on the other hand. Intermediate these two radially projecting circumferential ridges there are formed several through-openings 33 which are circumferentially uniformly distributed and through which the pressurized gas flows into the inner bag 3 (arrow 30 in FIG. 5).

The dispensing tube 17 is moved axially by a filling head which is not illustrated in detail.

The dispensing valve 2 or the valve body 14 thereof is centrally fixed to the container cover 34, as is known per se, so that this fixing structure need not be described in detail.

Figure 7:
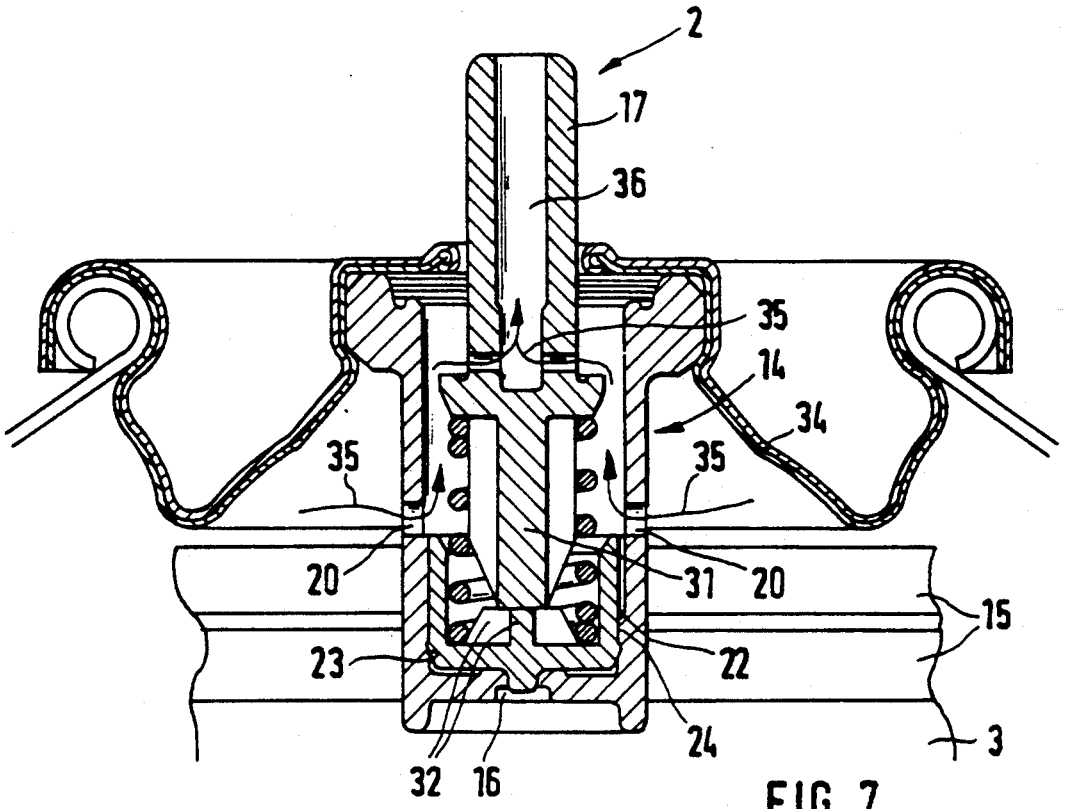
FIG. 7 illustrates the dispensing valve of FIG. 4 after filling of the inner bag with gas, wherein the dispensing tube is illustrated in the dispensing position.
Figure 8:
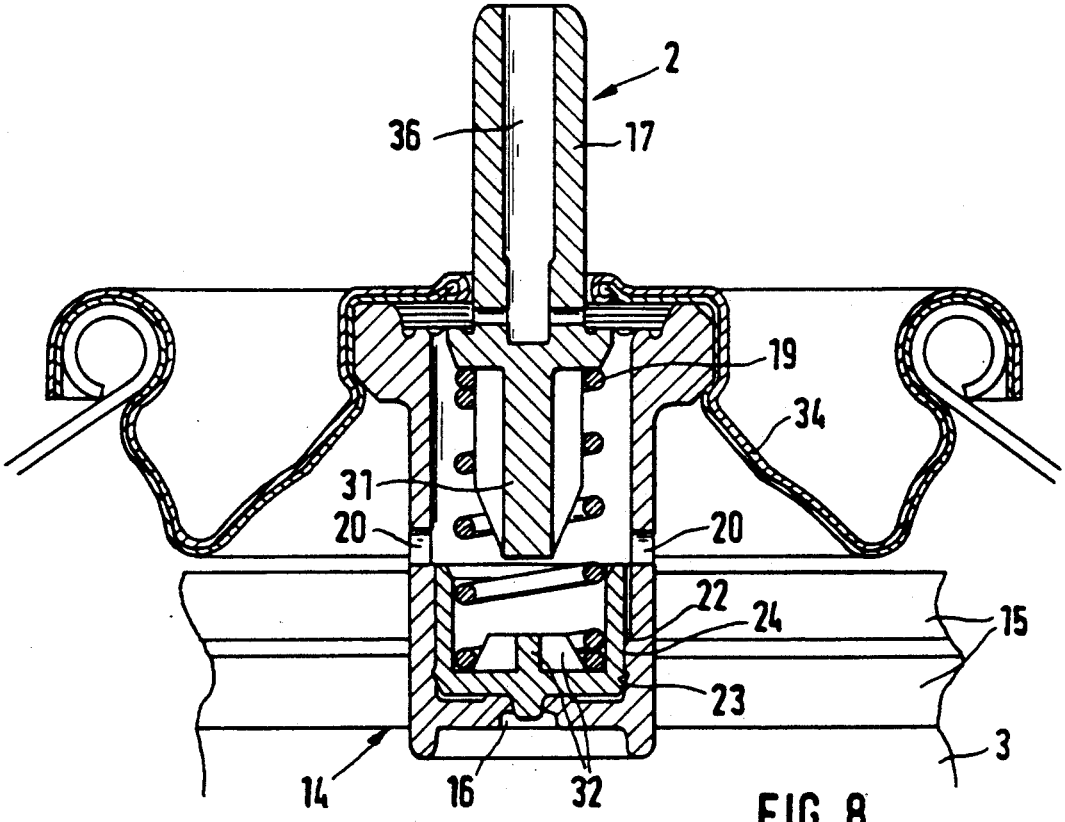
FIG. 8 is the dispensing valve of FIGS. 4 and 7, respectively, in the closed position.

FIG. 7 shows the dispensing tube 17 in the position for dispensing contents while the filling opening 16 is closed. As indicated by arrows 35, the contents may flow out via the openings 20, the interior of the valve body 14 and the fluid passageway 36 of the dispensing valve 17 under the action of the expanding inner bag 3. FIG. 8 shows the dispensing valve 2 in the closed position after filling of the outer container 1 and the introduction of gas into the inner bag 3 have been completed.

It should be noted with reference to FIG. 1 that a riser tube 35*a* connected to the filling opening 16 is placed between the two additional sealing strips 13 within the inner bag 3, said riser tube extending at least along approximately half the length of the inner bag 3. As already explained above, the riser tube substantially serves but to increase the buckling resistance of the inner bag 3 so that the latter can more easily be immersed in the filled container 1, especially when the contents consist of a pasty composition.

Figure 9:
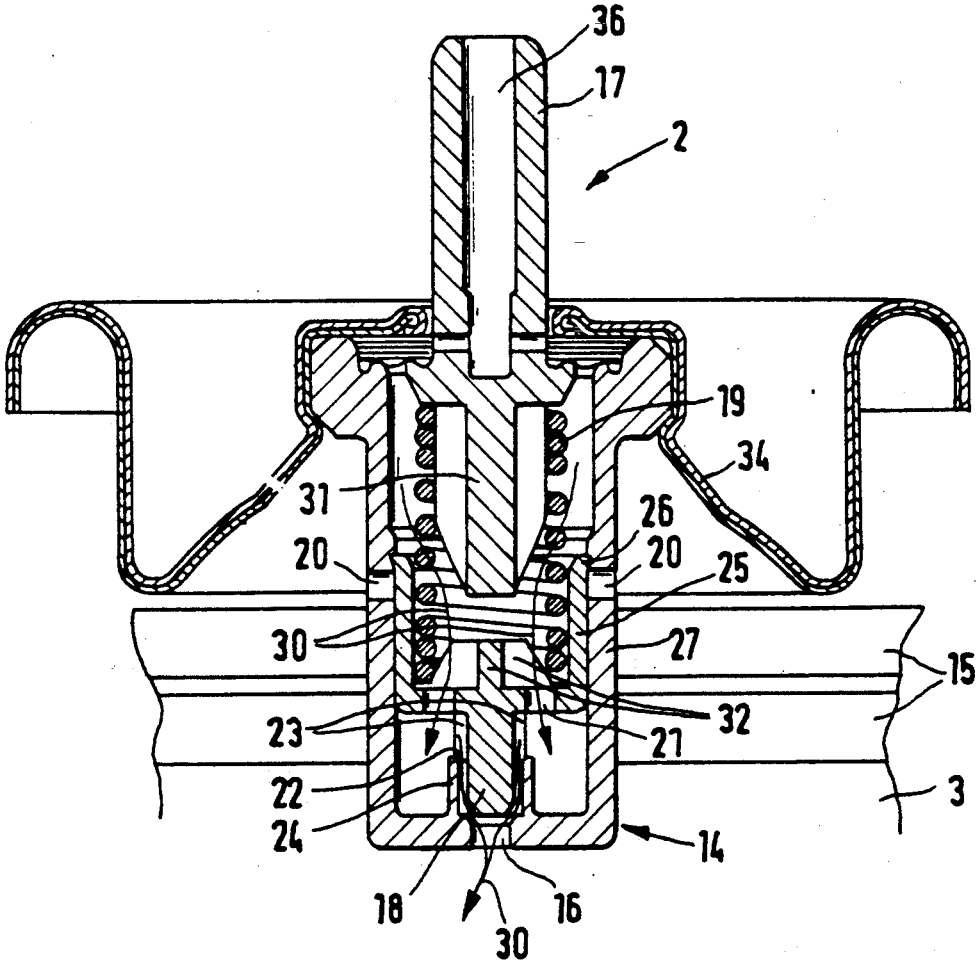
FIG. 9 is a longitudinal section and enlarged cross-section of a modified embodiment of a dispensing valve similar to the illustration of FIG. 3, i.e. prior to assembly with the outer container.

FIG. 9 illustrates an alternative structure of the dispensing valve relative to the closure plug 18. Elements of the dispensing valve 2 which have already been described with reference to the previous figures have been indicated by the same symbols, and for the description of their operation reference should be had to the above description. The embodiment illustrated in FIG. 9 is distinguished by the feature that the guide sleeve 25 across its entire circumference is in intimate engagement with the inside of the circumferential wall 27 which bounds the valve body 14 laterally. Accordingly, to permit the introduction of gas into the inner bag 3 the bottom of the cup-like guide sleeve 25 is provided with through-openings 21 through which the inner bag 3 is filled with gas when the closure plug 18 is lifted off the filling opening 16 (see the arrows 30). The locking means which cooperate with the closure plug 18 for holding it lifted off the filling opening 16 while the inner bag 13 is being filled with gas have been modified as compared with the previously described embodiment. The locking means 24 associated with the valve body 14 is formed by a clamping socket which is provided, especially integrally formed, in the interior of the valve body to surround the filling opening 16, whereas the locking means 22 associated with the closure plug 18 are formed by a plurality of circumferentially equally distributed radial ridges which with their ends inside the container rest against the circumferential edge of the clamping socket facing the dispensing tube 17 while the inner bag 3 is being filled with gas, so that the closure plug 18 is held in a position lifted off the filling opening 16 as shown in FIG. 9. When the inner bag 3 has been filled with pressurized gas the dispensing tube 17 is pressed still further into the container by the non-illustrated filling head so as to engage the previously described protrusion 32. During this movement the radial ridges 22 are pressed into the clamping socket 24 so that the closure plug 18, which is also pressed into the filling opening 16, is retained in the position where it closes the filling opening. Additionally, the closure plug 18 is retained in this position by the action of the compression spring 19 and by the sharp-edged circumferential rim 26 which in fact firmly grips the inside of the circumferential wall 27 bounding the valve body 14 laterally. Thereby, the inner bag 3 is permanently sealed in fluid-tight fashion after having been filled with gas. All other parts of the dispensing valve 2 illustrated in FIG. 9 are identical with those of the already described dispensing valve so that—as mentioned already—any detailed description of these parts may be omitted.

All of the features disclosed in the application documents are claimed as being essential to the invention insofar as they are novel over the prior art either individually or in combination.

We claim:

1. A dual-chamber package having a substantially dimensionally stable outer container (1) with a container bottom and a dispensing valve (2) for holding and dispensing a flowable medium including liquid or pasty contents and an inner container disposed in the outer container (1) for receiving a pressurized gas, said inner container (3) being a flexible inner bag and said dispensing valve (2) including a dispensing tube (17) disposed within a valve body (14) for movement from a closed position to an open position and vice versa, comprising the improvement wherein said inner bag (3) is connected to the dispensing valve (2) and filled therethrough with said pressurized gas with said outer container (1) filled with said flowable medium and closed, said dispensing valve (2) having a control for opening the valve and discharge said flowable medium from the outer container (1) in response to expansion of said inner bag (3) and said inner bag (3) including sheet material folded upon itself to form sidewalls having side edges (7,8) and having a folded bottom end constructed and arranged to form a substantially flat bag bottom (5) extended across the container bottom (4), said inner bag having at least one sealed portion (13) connecting said sidewalls and extending from an upper end of said inner bag facing the dispensing valve (2) towards the folded bottom end and located between the edges (7, 8) of said bag to form a releasably sealed joint (13), said sealed joint (13) having a strength to hold said sidewalls together and cause said folded bottom end to form said flat bag bottom (5) in response to initial introduction of said gas into inner bag and subsequently releasing said sidewalls.

2. The package according to claim 1, including a free space within the outer container bounded by the inner bag and the outer container (1) and the medium in the outer container with the inner bag (3) evacuated and whereby said pressurized gas in the inner bag (3) moves the medium up to the dispensing valve.

3. The package according to claim 1, wherein said inner bag (3) extends substantially along the entire length of the interior of the outer container (1) to said bottom end (4).

4. The package according to claim 1, wherein said folded bottom end comprises an inwardly directed V-fold (6) which extends transversely between the two side edges (7, 8) of the inner bag (3).

5. The package according to claim 4, wherein said inwardly directed V-fold (6) of the folded bottom end is limited at its diametrically opposed ends by obliquely inwardly directed sealing edges (9, 10 and 11, 12) forming extension of said longitudinal sealed edges (7, 8).

6. The package according to claim 1, wherein the length of said sealed joint (13) extending from the upper end of the inner bag (3) is in the range of ½ to ⅔ of the length of the inner bag (3), said sealed joint (13) being formed by a sealing strip.

7. The package of claim 1, wherein said valve body (14) is mounted in sealed relationship within said outer container (1) and extending into the inner bag (3), said valve body including a filling opening (16) which opens into the interior of the inner bag (3) for filling of the inner bag (3) with the pressurized gas via the dispensing valve (2), and a closure member (18) for closing said opening.

8. The package of claim 7, wherein said valve body includes a through-opening (20) communicating the interior of the outer container (1) with the interior of the valve body (14) and said dispensing tube (17), wherein said closure member (18) has an initial position for filling the inner bag (3) with the pressurized gas passing through said filling opening (16) and a second position closing the filling opening (16), said closure member in said initial position closing said through-opening (20) to close fluid communication between the interior of the outer container (1) and the dispensing tube (17) of the dispensing valve (2) while the inner bag (3) is being filled with pressurized gas and to open said through-opening (20) in said second position.

9. The package of claim 8, having an axially acting elastic member disposed between the closure member (18) and the dispensing tube and supporting said dispensing tube (17) in a first position for movement a second position into the valve body (14) and said closure member (18) thereby closing said through-opening (20) during filling of the inner bag (3) with said pressurized gas, said closure member (18) and said valve body (14) having a complementary locking means (22, 23, 24), said locking means having first locking elements (22, 23) engaged in the initial position of said closure member with said closure member supported spaced away from the filling opening (16) and with said pressurized gas adapted to flow through the dispensing tube (17) and past the closure member (18) into the inner bag (3), and wherein said movement of dispensing tube (17) to said second position releases said locking elements (22, 23) and moves the closure member to close the filling opening (16), and said locking means having a second locking elements (24) engaged in response to said last named movement of the dispensing tube to said second position and said closure member (18) to said second position and closing the filling opening (16), said engaged second locking elements positively holding said closure member in said second position.

10. The package of claim 9, wherein the material of said closure member (18) is harder than the material of the valve body (14).

11. The package of claim 10, wherein said elastic member is a helical compression spring and said closure member has a side facing the dispensing tube (17), said closure member (18) comprises a cup-like guide sleeve (25) with a portion of said helical compression spring (19) therein and said sleeve having an outer peripheral rim (23), said valve body having an inner cylindrical wall with an inward protrusion (24), said second locking elements of said locking means including said rim (23) and said protrusion 24, and said rim protruding radially outwardly with an outer sharp edge located engaging said inner protrusion (24) and operable in the second position of said closure member to inhibit any movement of the closure member (18) from the position in which it closes the filling opening (16).

12. The package of claim 1, including a riser tube (35*a*) coupled to said filling opening (16) and extending into said inner bag (3) for stabilizing the inner bag (3) and increasing its buckling resistance, said riser tube extending at least half the length of the inner bag (3).

13. The package of claim 1, wherein said inner bag (3) with the pressurized gas initially placed therein fills approximately one-third of the interior of the outer container (1), said pressurized gas having an initial pressure of about 9 bars and the medium is dispenses at a pressure of about 3 bars until the container is completely empty.

14. A dual-chamber package having a substantially dimensionally stable outer container (1) and dispensing valve (2) for holding and dispensing a flowable medium including liquid or pasty contents, an inner container (3) disposed in the outer container (1) for receiving a pressurized gas, said inner container (3) being a flexible inner bag and said dispensing valve (2) including a dispensing tube (17) disposed within a valve body, said valve body (14) mounted in sealed relationship within said outer container (1) and extending into the inner bag (3), said valve body including a filling opening (16) which opens into the interior of the inner bag (3) for filling of the inner bag with the pressurized gas through said dispensing valve (2), a closure member (18) for closing said filling opening (16), said valve body includes a through-opening (20) communicating the interior of the outer container (1) with the interior of the valve body (14) and said dispensing tube (17), said closure member (18) having an initial position for filling the inner bag (3) with the pressurized gas through said filling opening (16) and a second position closing said filling opening (16), said closure member (18) in said initial position closing said through-opening (20) to close fluid communication between the interior of the outer container (1) and the dispensing tube (17) of the dispensing valve (2) while the inner bag (3) is filled with pressurized gas and said closure member (18) in said second position opening said through-opening (20) and closing said filling opening (16), and said dispensing tube being operable to move the closure member to the second position.

15. The package of claim 14, having an axially acting elastic member disposed between the closure member (18) and the dispensing tube (17) and supporting said dispensing tube (17) in a first position for movement into the valve body (18), said closure member closing said through-opening (20) during filling of the inner bag (3) with said pressurized gas, said closure member (18) and said valve body (14) having complementary locking means (22,23,24) said locking means having first locking elements engaged in the initial position of said closure member with said closure member supported spaced away from the filling opening and with said pressurized gas adapted to flow through the dispensing tube (17) and past the closure member (18) into the inner bag (3), and wherein said movement of dispensing tube (17) and said closure member to said second position releases the locking elements (22,23) allowing the closure member to close the filling opening (16), and said locking means (22,23,24) having second locking elements (23,24) engaged in response to said last named movement of the dispensing tube and said closure member to said second position and closing the filling opening (16) said engaged second locking elements positively holding said closure member in said second position.

* * * * *

UNITED STATES PATENT AND TRADEMARK OFFICE

CERTIFICATE OF CORRECTION

PATENT NO. : 5,211,316

DATED : May 18, 1993

INVENTOR(S) : ADALBERTO GEIER ET AL

It is certified that error appears in the above-identified patent and that said Letters Patent is hereby corrected as shown below:

Claim 9, col. 8, line 38, after "movement" insert ---to---;

Claim 14, col. 10, line 8, after "is" insert ---being---; Claim 15, col. 10, line 17, after "movement" insert ---in a second position---; Claim 15, col. 10, line 26, after "opening" insert ---(16)---.

Signed and Sealed this

Thirty-first Day of January, 1995

Bruce Lehman

*Attest:*

BRUCE LEHMAN

*Attesting Officer*

*Commissioner of Patents and Trademarks*